US009152099B2

(12) United States Patent
Ueno et al.

(10) Patent No.: US 9,152,099 B2
(45) Date of Patent: Oct. 6, 2015

(54) FIXING DEVICE, IMAGE FORMING APPARATUS, AND FIXING METHOD

(71) Applicants: Satoshi Ueno, Tokyo (JP); Tetsuo Tokuda, Kanagawa (JP); Naoto Suzuki, Kanagawa (JP); Takashi Sakamaki, Kanagawa (JP); Kohichi Utsunomiya, Kanagawa (JP); Fumihiro Hirose, Kanagawa (JP); Motoyoshi Yamano, Tokyo (JP)

(72) Inventors: Satoshi Ueno, Tokyo (JP); Tetsuo Tokuda, Kanagawa (JP); Naoto Suzuki, Kanagawa (JP); Takashi Sakamaki, Kanagawa (JP); Kohichi Utsunomiya, Kanagawa (JP); Fumihiro Hirose, Kanagawa (JP); Motoyoshi Yamano, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/205,826

(22) Filed: Mar. 12, 2014

(65) Prior Publication Data

US 2014/0294456 A1 Oct. 2, 2014

(30) Foreign Application Priority Data

Mar. 28, 2013 (JP) ..... 2013-069612

(51) Int. Cl.
*G03G 15/20* (2006.01)

(52) U.S. Cl.
CPC ..... *G03G 15/2025* (2013.01); *G03G 15/2032* (2013.01); *G03G 15/2067* (2013.01); *G03G 15/2075* (2013.01); *G03G 2215/2032* (2013.01)

(58) Field of Classification Search
CPC ..... G03G 15/2025; G03G 15/2075; G03G 15/2032; G03G 15/2067; G03G 15/2035; G03G 15/2071
USPC ..... 399/327
See application file for complete search history.

(56) References Cited

U.S. PATENT DOCUMENTS

| | | | | |
|---|---|---|---|---|
| 4,272,666 | A * | 6/1981 | Collin | 219/216 |
| 4,533,235 | A * | 8/1985 | Uchida | 399/357 |
| 5,436,711 | A * | 7/1995 | Hauser | 399/328 |
| 8,254,819 | B2 * | 8/2012 | Okamoto | 399/329 |
| 2007/0048039 | A1 * | 3/2007 | Kakishima et al. | 399/327 |
| 2011/0188904 | A1 * | 8/2011 | Kageyama et al. | 399/323 |
| 2011/0229224 | A1 | 9/2011 | Watanabe | |
| 2012/0195623 | A1 | 8/2012 | Okamoto | |
| 2014/0193181 | A1 * | 7/2014 | Nakamura et al. | 399/327 |

FOREIGN PATENT DOCUMENTS

| | | |
|---|---|---|
| JP | 51-109739 | 9/1976 |
| JP | 63-313182 | 12/1988 |

(Continued)

*Primary Examiner* — David Gray
*Assistant Examiner* — Tyler Hardman
(74) *Attorney, Agent, or Firm* — Harness, Dickey & Pierce, P.L.C.

(57) ABSTRACT

A fixing device includes a pressing rotary body to press against a fixing rotary body. A pivotable pressure lever rotatably mounts the pressing rotary body. A pressurization cam assembly pivots the pressure lever to press the pressing rotary body against the fixing rotary body and release pressure between the pressing rotary body and the fixing rotary body. A pivotable cleaning unit includes a cleaning web separably contacting the pressing rotary body to clean the pressing rotary body, a pressure adjuster contacting the cleaning web to separably press the cleaning web against the pressing rotary body, a take-up reel to reel up the cleaning web, and a supply reel to reel out the cleaning web. A cleaning unit cam assembly contacts the cleaning unit to pivot the cleaning unit to press against and separate from the pressing rotary body.

14 Claims, 7 Drawing Sheets

(56) References Cited

FOREIGN PATENT DOCUMENTS

| | | |
|---|---|---|
| JP | 1-263679 | 10/1989 |
| JP | 2000-321914 | 11/2000 |
| JP | 2011-081136 | 4/2011 |
| JP | 2011-164132 | 8/2011 |
| JP | 2011-215587 | 10/2011 |
| JP | 2012-159594 | 8/2012 |
| JP | 2013-019935 | 1/2013 |

* cited by examiner

FIXING DEVICE, IMAGE FORMING APPARATUS, AND FIXING METHOD

CROSS-REFERENCE TO RELATED APPLICATION

This patent application is based on and claims priority pursuant to 35 U.S.C. §119 to Japanese Patent Application No. 2013-069612, filed on Mar. 28, 2013, in the Japanese Patent Office, the entire disclosure of which is hereby incorporated by reference herein.

BACKGROUND

1. Technical Field

Example embodiments generally relate to a fixing device, an image forming apparatus, and a fixing method, and more particularly, to a fixing device for fixing a toner image on a recording medium, an image forming apparatus incorporating the fixing device, and a fixing method for fixing a toner image on a recording medium.

2. Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

The image forming apparatuses employ fixing devices of various types, such as a roller type, a film type, and an induction heating type.

For example, the roller type fixing device may include a fixing roller heated by a heater and a pressure roller pressed against the fixing roller to form a fixing nip therebetween. As a recording medium bearing a toner image is conveyed through the fixing nip, the fixing roller and the pressure roller apply heat and pressure to the recording medium, melting and fixing the toner image on the recording medium.

The film type fixing device may include a fixing film and a heater contacting the fixing film as disclosed by JP-S63-313182-A and JP-H1-263679-A. For example, a pressure roller presses a recording medium bearing a toner image against the heater via the fixing film. As the fixing film sliding over the heater conveys the recording medium, the fixing film heated by the heater heats the recording medium.

The induction heating type fixing device may include a fixing sleeve incorporating a heat generation layer, a fixing roller disposed inside the fixing sleeve, and a pressure roller pressed against the fixing roller via the fixing sleeve to form a fixing nip between the fixing sleeve and the pressure roller. The heat generation layer of the fixing sleeve generates heat by induction heating. As a recording medium bearing a toner image is conveyed through the fixing nip, the fixing sleeve heats the recording medium.

A contact member that contacts the recording medium, that is, the fixing roller, the fixing film, the fixing sleeve, or the pressure roller described above, may receive contaminants, such as unfixed toner and paper dust, from the recording medium. If the contaminants adhere to and accumulate on the contact member, the contaminants may be transferred onto a recording medium conveyed through the fixing nip. To address this circumstance, a roll type cleaning web may contact the contact member to wipe the contaminants off the contact member as disclosed by JP-2000-321914-A and JP-2011-215587-A. The cleaning web is reeled to bring a fresh portion of the cleaning web into contact with the contact member constantly. Hence, the contaminants do not accumulate on the cleaning web.

Since the cleaning web is reeled constantly, it is requested to reduce consumption of the cleaning web. However, it may be difficult to reduce consumption of the cleaning web because reduced consumption of the cleaning web may degrade cleaning performance to clean the contact member. Accordingly, the unclean contact member may damage the toner image on the recording medium, resulting in degradation in quality of the toner image formed on the recording medium.

SUMMARY

At least one embodiment provides a novel fixing device that includes a fixing rotary body and a pressing rotary body to press against the fixing rotary body to form a fixing nip therebetween through which a recording medium is conveyed. A pivotable pressure lever rotatably mounts the pressing rotary body. A pressurization cam assembly contacts the pressure lever to pivot the pressure lever to press the pressing rotary body against the fixing rotary body and release pressure between the pressing rotary body and the fixing rotary body. A pivotable cleaning unit is separably pressed against the pressing rotary body. The cleaning unit includes a cleaning web separably contacting the pressing rotary body to clean the pressing rotary body, a pressure adjuster contacting the cleaning web to separably press the cleaning web against the pressing rotary body, a take-up reel to reel up the cleaning web, and a supply reel to reel out the cleaning web. A cleaning unit cam assembly contacts the cleaning unit to pivot the cleaning unit to press against and separate from the pressing rotary body.

At least one embodiment provides a novel fixing device that includes a fixing rotary body and a pressing rotary body to press against the fixing rotary body to form a fixing nip therebetween through which a recording medium is conveyed. A pivotable pressure lever rotatably mounts the pressing rotary body. A pressurization cam assembly contacts the pressure lever to pivot the pressure lever to press the pressing rotary body against the fixing rotary body and release pressure between the pressing rotary body and the fixing rotary body. A pivotable cleaning unit is separably pressed against the pressing rotary body to clean the pressing rotary body. A cleaning unit cam assembly contacts the cleaning unit to pivot the cleaning unit to press against and separate from the pressing rotary body. A controller is operatively connected to the pressurization cam assembly and the cleaning unit cam assembly. The controller selectively controls the pressurization cam assembly to press the pressing rotary body against the fixing rotary body and the cleaning unit cam assembly to press the cleaning unit against the pressing rotary body.

At least one embodiment provides a novel image forming apparatus that includes the fixing device described above.

At least one embodiment provides a novel fixing method that includes starting pressing a pressing rotary body against a fixing rotary body, detecting that the pressing rotary body starts pressing against the fixing rotary body, starting counting, detecting that a preset time elapses after starting counting, and starting pressing a cleaning unit against the pressing rotary body.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1A:
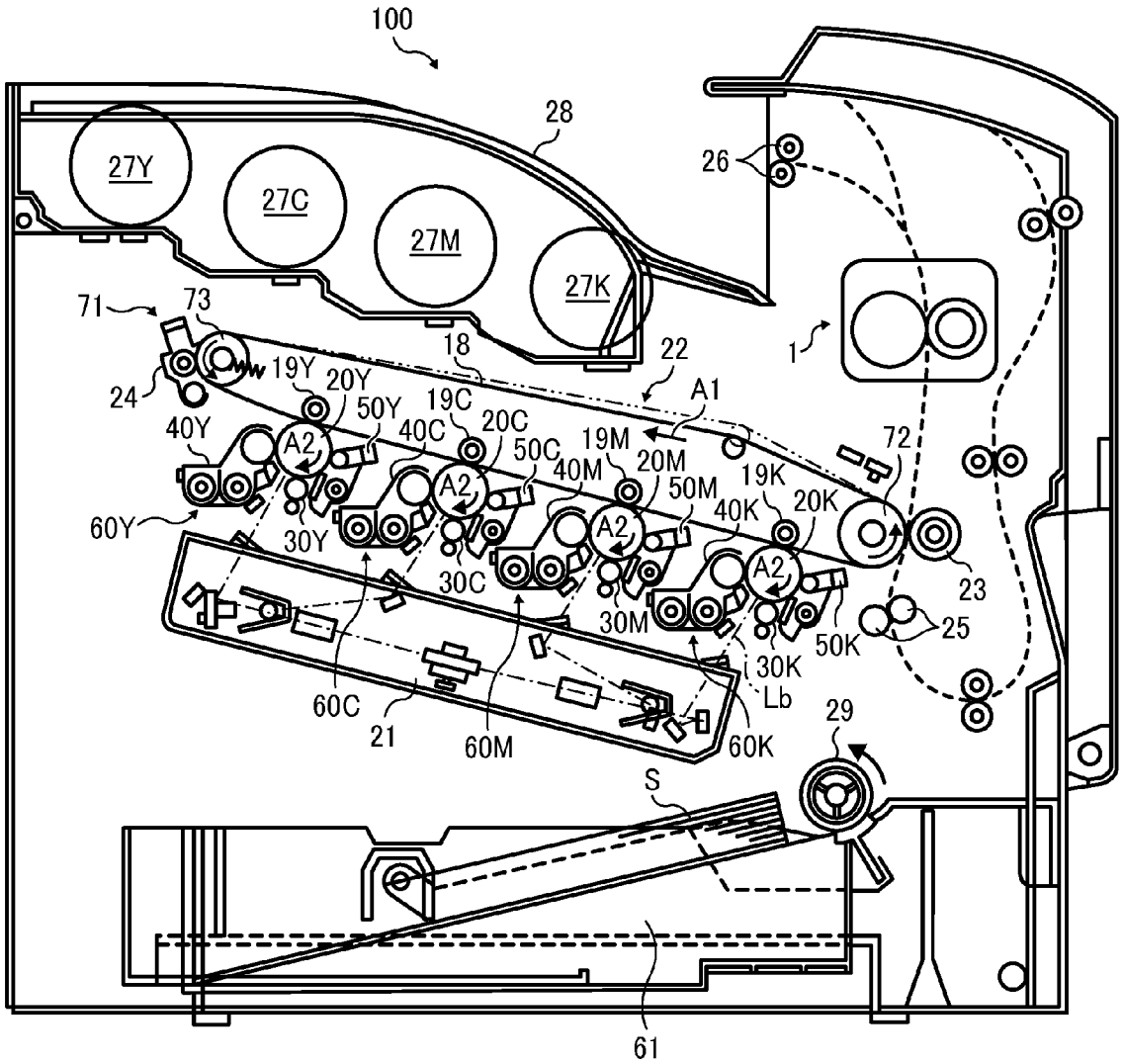
FIG. 1A is a schematic vertical sectional view of an image forming apparatus according to an example embodiment of the present invention.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1A, an image forming apparatus 100 according to an example embodiment is explained.

FIG. 1A is a schematic vertical sectional view of the image forming apparatus 100. The image forming apparatus 100 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 100 is a color printer that forms color and monochrome toner images on recording media by electrophotography. Alternatively, the image forming apparatus 100 may be a monochrome printer that forms monochrome toner images.

The image forming apparatus 100 is a tandem color printer incorporating a plurality of image forming devices, that is, four imaging stations 60Y, 60C, 60M, and 60K for forming yellow, cyan, magenta, and black toner images, respectively, that are aligned in a stretch direction of a transfer belt 18 stretched taut across a plurality of rollers. For example, the four imaging stations 60Y, 60C, 60M, and 60K include four photoconductive drums 20Y, 20C, 20M, and 20K serving as image carriers that bear yellow, cyan, magenta, and black toner images, respectively.

The yellow, cyan, magenta, and black toner images formed on the photoconductive drums 20Y, 20C, 20M, and 20K, respectively, are primarily transferred onto the transfer belt 18 serving as an intermediate transferor rotatable in a rotation direction A1 and disposed opposite the photoconductive drums 20Y, 20C, 20M, and 20K such that the yellow, cyan, magenta, and black toner images are superimposed on a same position on the transfer belt 18. The yellow, cyan, magenta, and black toner images superimposed on the transfer belt 18 are secondarily transferred onto a recording medium S (e.g., a sheet) collectively, thus forming a color toner image on the recording medium S.

The photoconductive drums 20Y, 20C, 20M, and 20K are surrounded by devices for forming the yellow, cyan, magenta, and black toner images on the photoconductive drums 20Y, 20C, 20M, and 20K, respectively, as the photoconductive drums 20Y, 20C, 20M, and 20K rotate in a rotation direction A2. Taking the photoconductive drum 20K for forming the black toner image, for example, a charger 30K, a development device 40K, a primary transfer roller 19K, and a cleaner 50K are arranged in the rotation direction A2 of the photoconductive drum 20K. Below the four imaging stations 60Y, 60C, 60M, and 60K incorporating the four photoconductive drums 20Y, 20C, 20M, and 20K, respectively, is an optical writer 21 that writes an electrostatic latent image on the respective photoconductive drums 20Y, 20C, 20M, and 20K charged by the chargers 30Y, 30C, 30M, and 30K.

As the transfer belt 18 rotates in the rotation direction A1, the yellow, cyan, magenta, and black toner images formed on the photoconductive drums 20Y, 20C, 20M, and 20K are primarily transferred onto the transfer belt 18 such that the yellow, cyan, magenta, and black toner images are superimposed on the same position on the transfer belt 18. For example, a voltage is applied to the primary transfer rollers 19Y, 19C, 19M, and 19K disposed opposite the photoconductive drums 20Y, 20C, 20M, and 20K via the transfer belt 18, respectively, at different times from the upstream primary transfer roller 19Y to the downstream primary transfer roller 19K in the rotation direction A1 of the transfer belt 18.

The photoconductive drums 20Y, 20C, 20M, and 20K are arranged in this order in the rotation direction A1 of the transfer belt 18 from left to right in FIG. 1A. As described above, the four photoconductive drums 20Y, 20C, 20M, and 20K are incorporated in the four imaging stations 60Y, 60C, 60M, and 60K that form the yellow, cyan, magenta, and black toner images, respectively. Above the four imaging stations 60Y, 60C, 60M, and 60K is a transfer belt unit 22 disposed opposite the photoconductive drums 20Y, 20C, 20M, and 20K and incorporating the transfer belt 18 and the primary transfer rollers 19Y, 19C, 19M, and 19K. The transfer belt 18 is looped over a driving roller 72 and a driven roller 73. A secondary transfer roller 23 is disposed opposite the transfer belt 18 and rotatable in accordance with rotation of the transfer belt 18. A belt cleaner 24, disposed opposite the transfer belt 18, cleans the transfer belt 18. Below the four imaging stations 60Y, 60C, 60M, and 60K is the optical writer 21 disposed opposite the imaging stations 60Y, 60C, 60M, and 60K.

The optical writer 21 includes a semiconductor laser serving as a light source, a coupling lens, an f-θ lens, a troidal lens, deflection mirrors, and a polygon mirror serving as a deflector. The optical writer 21 emits light Lb onto the photoconductive drums 20Y, 20C, 20M, and 20K according to yellow, cyan, magenta, and black image data sent from an external device such as a client computer, thus forming an electrostatic latent image on the respective photoconductive drums 20Y, 20C, 20M, and 20K.

Below the optical writer 21 is a sheet feeder 61 incorporating a paper tray that loads a plurality of recording media S to be conveyed to a secondary transfer nip formed between the secondary transfer roller 23 and the transfer belt 18. Below the secondary transfer nip is a registration roller pair 25 that feeds a recording medium S conveyed from the sheet feeder 61 to the secondary transfer nip at a time when the color toner image formed on the transfer belt 18 reaches the secondary transfer nip. A sensor is situated below the secondary transfer nip to detect a leading edge of the recording medium S that reaches the registration roller pair 25.

Downstream from the transfer belt unit 22 in a recording medium conveyance direction is a fixing device 1 that fixes the color toner image transferred from the transfer belt 18 onto the recording medium S thereon. Downstream from the fixing device 1 in the recording medium conveyance direction is an output roller pair 26 that discharges the recording medium S bearing the fixed color toner image onto an outside of the image forming apparatus 100. Above the transfer belt unit 22 are four toner bottles 27Y, 27C, 27M, and 27K that contain fresh yellow, cyan, magenta, and black toners to be supplied to the development devices 40Y, 40C, 40M, and 40K of the imaging stations 60Y, 60C, 60M, and 60K, respectively. Above the toner bottles 27Y, 27C, 27M, and 27K is an output tray 28 disposed atop the image forming apparatus 100 to receive the recording medium S discharged by the output roller pair 26.

The driven roller 73 also serves as a tension applicator to exert tension to the transfer belt 18. For example, the driven roller 73 is anchored with a biasing member such as a spring that biases the driven roller 73 against the transfer belt 18. The transfer belt unit 22 incorporating the primary transfer rollers 19Y, 19C, 19M, and 19K and the transfer belt 18, the secondary transfer roller 23, and the belt cleaner 24 constitute a transfer device 71.

The sheet feeder 61 disposed in a lower portion of the image forming apparatus 100 further includes a feed roller 29 contacting an upper front side of an uppermost recording medium S of the plurality of recording media S loaded on the paper tray. As the feed roller 29 rotates counterclockwise in FIG. 1A, the feed roller 29 picks up and feeds the uppermost recording medium S toward the registration roller pair 25.

The belt cleaner 24 of the transfer device 71 includes a cleaning brush and a cleaning blade disposed opposite the transfer belt 18 to come into contact with the transfer belt 18. The cleaning brush and the cleaning blade scrape and remove a foreign substance such as residual toner off the transfer belt 18, thus cleaning the transfer belt 18. The belt cleaner 24 further includes a discharger to discharge residual toner removed from the transfer belt 18 to a waste toner container.

Figure 1B:
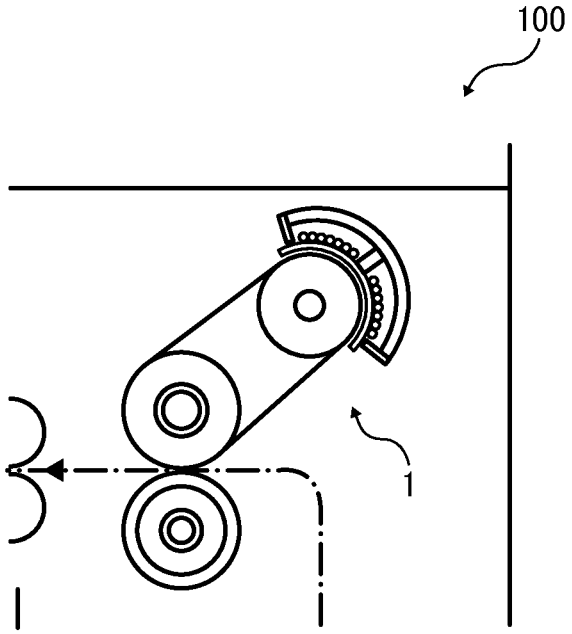
FIG. 1B is a partial vertical sectional view of the image forming apparatus shown in FIG. 1A illustrating a variation of a fixing device incorporated therein.

FIG. 1B is a partial vertical sectional view of the image forming apparatus 100 illustrating a variation of the fixing device 1 incorporated therein. As shown in FIG. 1B, the fixing device 1 may be located inside the image forming apparatus 100 such that the recording medium S is conveyed through the fixing device 1 horizontally.

Figure 2:
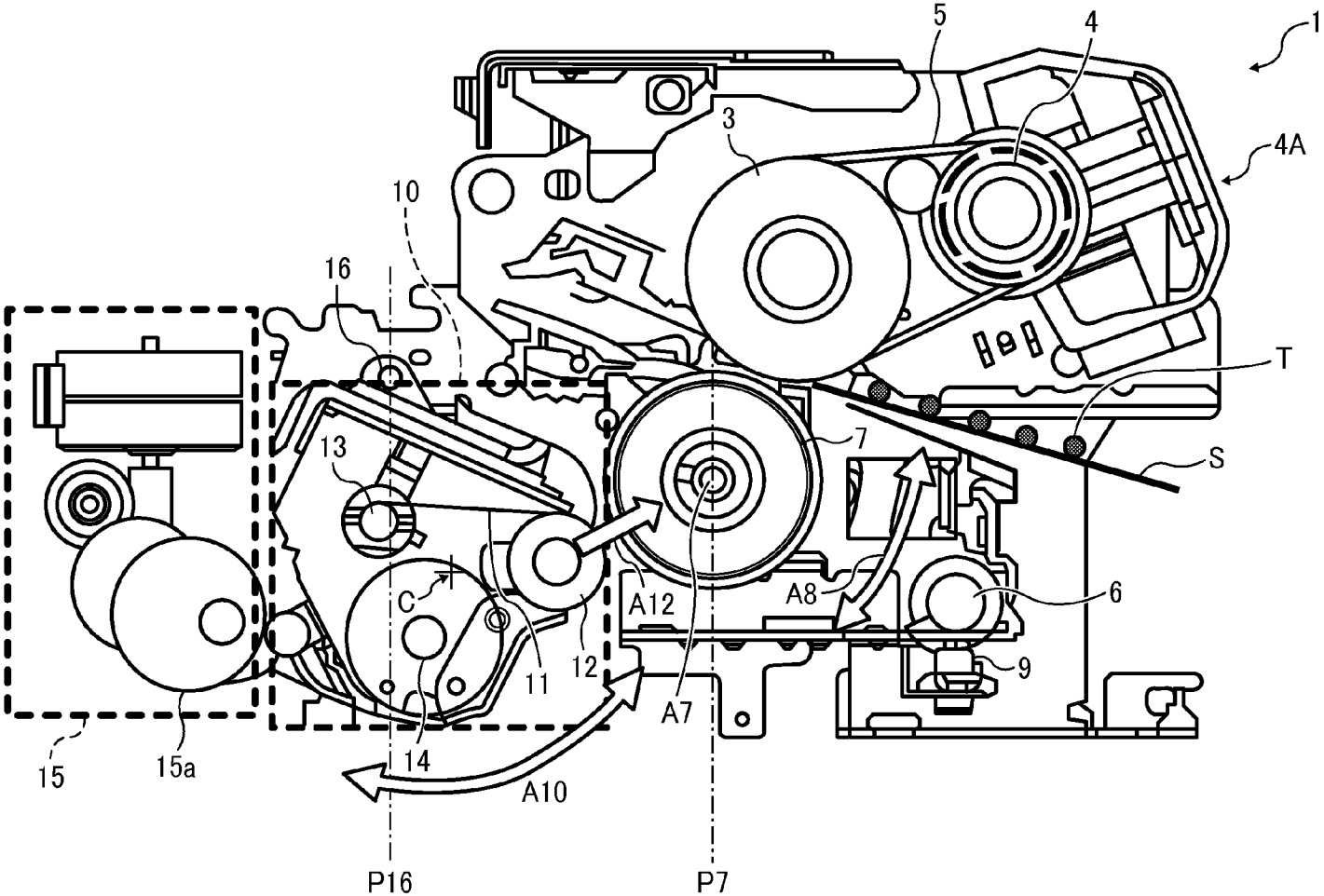
FIG. 2 is a vertical sectional view of the fixing device incorporated in the image forming apparatus shown in FIG. 1B.
Figure 3:
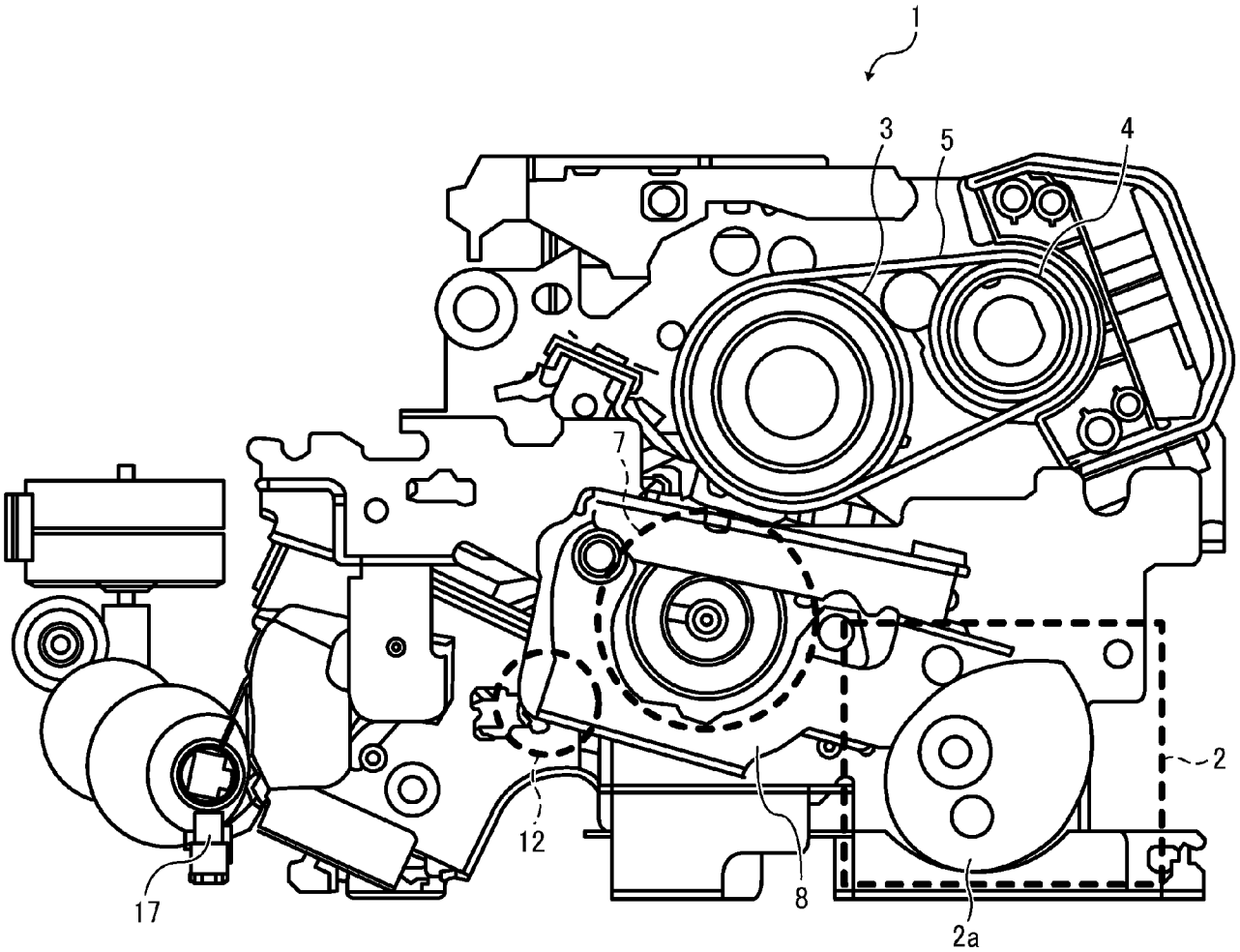
FIG. 3 is a front view of the fixing device shown in FIG. 2.
Figure 4:
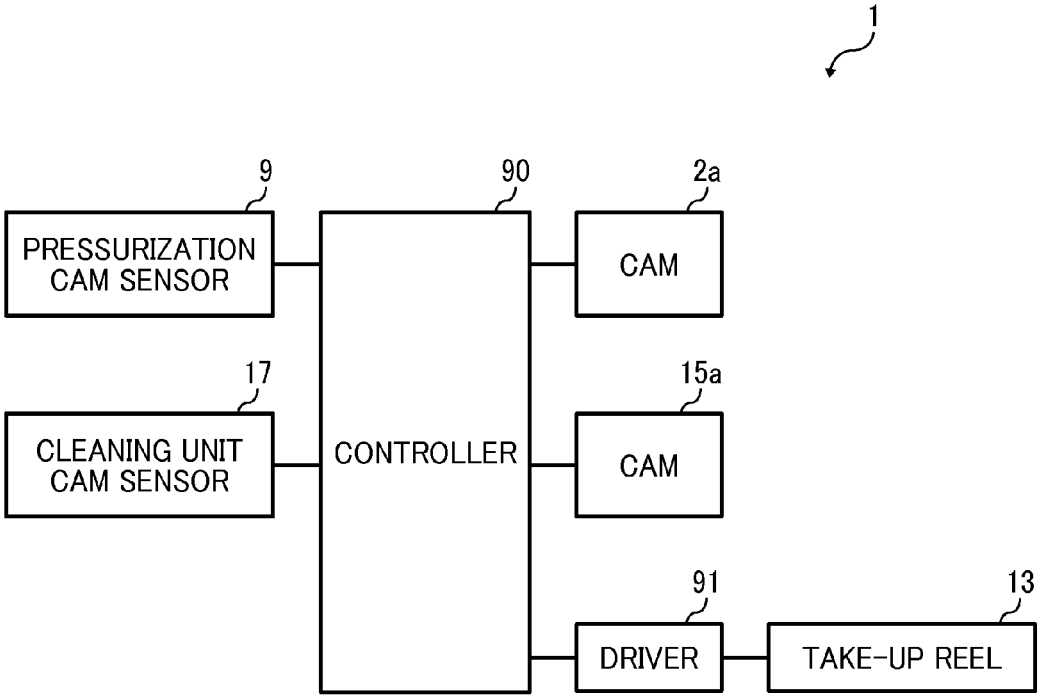
FIG. 4 is a block diagram of the fixing device shown in FIG. 2.

With reference to FIGS. 2 to 4, a description is provided of a construction of the fixing device 1 incorporated in the image forming apparatus 100 described above.

FIG. 2 is a vertical sectional view of the fixing device 1. FIG. 3 is a front view of the fixing device 1. FIG. 4 is a block diagram of the fixing device 1.

As shown in FIG. 2, the fixing device 1 (e.g., a fuser or a fuser unit) includes a fixing belt 5 serving as a fixing rotary body looped over a fixing roller 3 and a support roller 4 and a pressure roller 7 serving as a pressing rotary body separably pressed against the fixing roller 3 via the fixing belt 5 to form a fixing nip between the pressure roller 7 and the fixing belt 5. The fixing belt 5 is heated by a heater 4A disposed opposite an outer circumferential surface of the fixing belt 5. As shown in FIG. 3, the pressure roller 7 is rotatably supported by a pivotable pressure lever 8. The pressure lever 8 is pivotable by a pressurization cam assembly 2 incorporating a cam 2*a*. As shown in FIG. 2, the pressurization cam assembly 2 further includes a cam shaft 6 and a pressurization cam sensor 9 disposed opposite the cam shaft 6 to detect the position of the cam shaft 6. Based on a signal output from the pressurization cam sensor 9, movement of a cleaning unit 10 described below is controlled. As the image forming apparatus 100 depicted in FIGS. 1A and 1B receives a print job, a recording medium S bearing a toner image T is conveyed through the fixing nip formed between the fixing belt 5 and the pressure roller 7.

A detailed description is now given of a construction of the cleaning unit 10.

The cleaning unit 10 is a single-piece construction that includes a cleaning web 11, a pressure adjuster 12, a take-up reel 13, and a supply reel 14. The cleaning web 11 is made of a nonwoven fabric, cleaning paper, or the like. The cleaning web 11 is wound around the supply reel 14 in a roll form. The cleaning web 11 is looped over the pressure adjuster 12 and the take-up reel 13 so that as a driver 91 depicted in FIG. 4 drives and rotates the take-up reel 13, the take-up reel 13 reels up the cleaning web 11 in a given amount at a given speed. The pressure adjuster 12 is a roller made of an elastic body such as sponge. The pressure adjuster 12 pressing against the pressure roller 7 in a direction A12 adjusts pressure exerted by the pressure roller 7 to the fixing roller 3. A reverse rotation preventive member is mounted on the supply reel 14 to prevent the supply reel 14 from reeling out the cleaning web 11 in an amount greater than a preset amount as the take-up reel 13 rotates and reels up the cleaning web 11.

The cleaning unit 10 is pivotable about a pivot shaft 16 in a direction A10 by a cleaning unit cam assembly 15 incorporating a cam 15*a*. As the cleaning unit 10 pivots about the pivot shaft 16, the pressure adjuster 12 presses against the pressure roller 7 via the cleaning web 11 to form a cleaning nip between the cleaning web 11 and the pressure roller 7 where contaminants move from the pressure roller 7 to the cleaning web 11, thus allowing the cleaning web 11 to clean the pressure roller 7. The contaminants include paper dust moved from the recording medium S to the pressure roller 7 and unfixed toner failed to be fixed on the recording medium S and therefore adhered to the fixing belt 5, which in turn is moved from the fixing belt 5 to the pressure roller 7. The cleaning unit cam assembly 15 brings the cleaning unit 10 into contact with or isolation from the pressure roller 7. As shown in FIG. 3, the cleaning unit cam assembly 15 further includes a cleaning unit cam sensor 17 disposed opposite the cleaning unit 10 to detect the cleaning unit 10.

Since the cleaning web 11 contacts the pressure roller 7, not the fixing belt 5 coming into contact with the toner image T on the recording medium S, the cleaning web 11 does not damage the outer circumferential surface of the fixing belt 5 that comes into contact with the toner image T on the recording medium S. If the cleaning web 11 is configured to come into contact with the fixing belt 5 to collect contaminants from the fixing belt 5, the contaminants collected by the cleaning web 11 from the outer circumferential surface of the fixing belt 5 may contain a slight amount of toner particles that is visually unrecognizable. Conversely, if the cleaning web 11 is configured to come into contact with the pressure roller 7 to collect contaminants from the pressure roller 7, the slight amount of contaminants is partially collected from the fixing belt 5 onto the recording medium S and the rest of the contaminants moves from the fixing belt 5 to the pressure roller 7 as the pressure roller 7 comes into contact with the fixing belt 5. Accordingly, the cleaning web 11 configured to come into contact with the pressure roller 7 collects contaminants in an amount smaller than an amount of contaminants collected by the cleaning web 11 configured to come into contact with the fixing belt 5, resulting in an extended life of the cleaning web 11.

Additionally, since the cleaning web 11 separably contacts the pressure roller 7, the cleaning web 11 selectively comes into contact with the pressure roller 7, resulting in a further extended life of the cleaning web 11. The recording medium S may be accidentally jammed between the fixing belt 5 and the pressure roller 7 and therefore the pressure roller 7 may rotate backward to convey the recording medium S backward. In this case, if the cleaning web 11 does not separate from the pressure roller 7, the pressure roller 7 may pull the cleaning web 11 from the supply reel 14. To address this circumstance, according to this example embodiment, the cleaning web 11 separates from the pressure roller 7.

As shown in FIG. 2, a center C of gravity of the cleaning unit 10 is situated in a region defined by a perpendicular P16 passing through the pivot shaft 16 of the cleaning unit 10 and a perpendicular P7 passing through a rotation shaft A7 of the pressure roller 7. Hence, the cleaning unit 10 is constantly exerted with a force that places the cleaning unit 10 immediately below the pivot shaft 16 by the weight of the cleaning unit 10. Accordingly, the cleaning unit 10 is exerted with a force that separates the cleaning unit 10 from the pressure roller 7 spontaneously. The cam 15*a* of the cleaning unit cam assembly 15 suppresses the force that separates the cleaning unit 10 from the pressure roller 7, positioning the cleaning unit 10 precisely.

The center C of gravity of the cleaning unit 10 situated in the region defined by the perpendicular P16 passing through the pivot shaft 16 of the cleaning unit 10 and the perpendicular P7 passing through the rotation shaft A7 of the pressure roller 7 separates the cleaning unit 10 from the pressure roller 7 spontaneously by the weight of the cleaning unit 10 without a force that biases the cleaning unit 10 in a direction in which the cleaning unit 10 separates from the pressure roller 7. Additionally, the cleaning unit cam assembly 15 moves the cleaning unit 10 toward the pressure roller 7, positioning the cleaning unit 10 precisely with respect to the pressure roller 7 and thus saving space at reduced manufacturing costs.

With reference to FIGS. 2 to 7, a description is provided of a relation between movement of the cleaning unit 10 to press against and separate from the pressure roller 7 and movement of the pressure roller 7 to press against and separate from the fixing belt 5.

Figure 5:
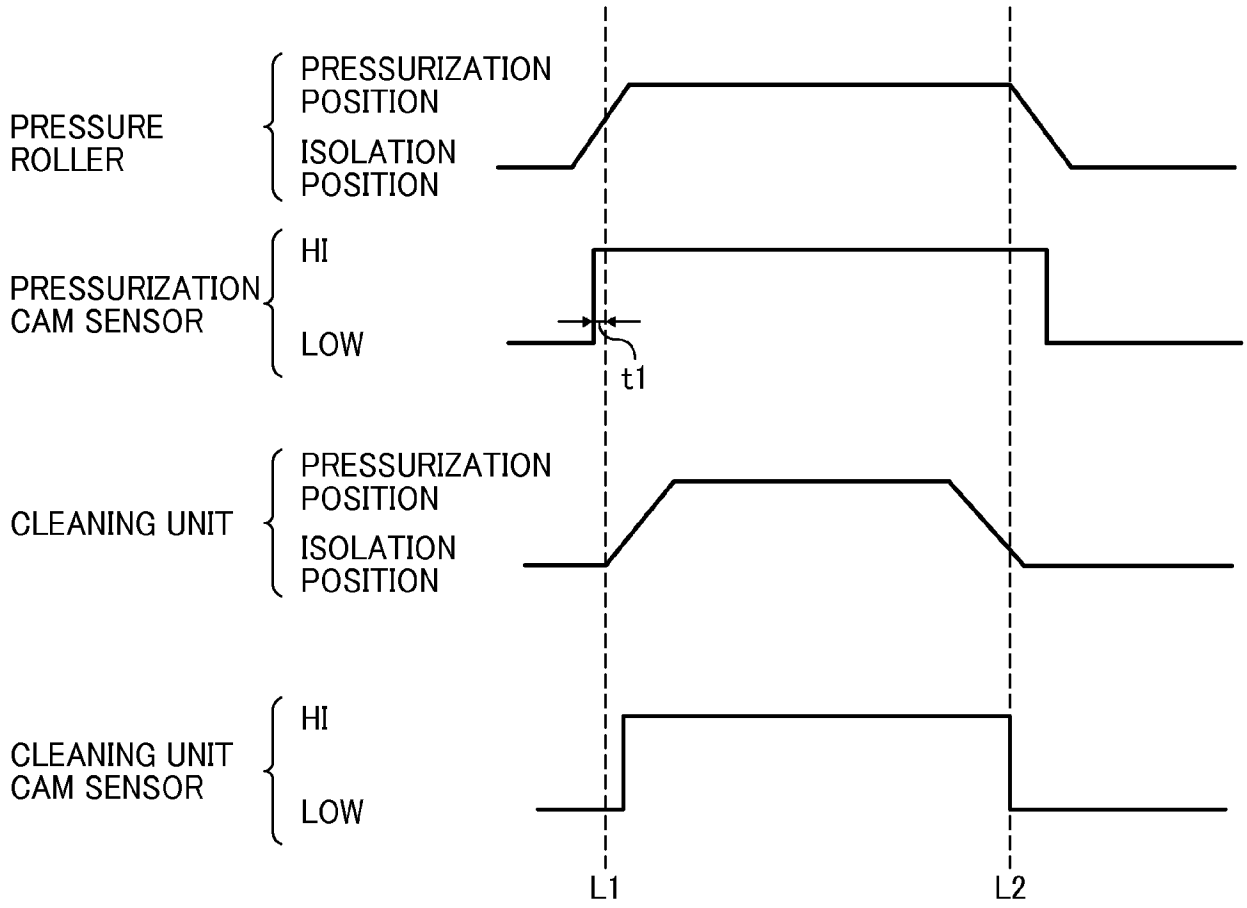
FIG. 5 is a timing chart showing control processes for moving a pressure roller and a cleaning unit incorporated in the fixing device shown in FIG. 2.
Figure 6:
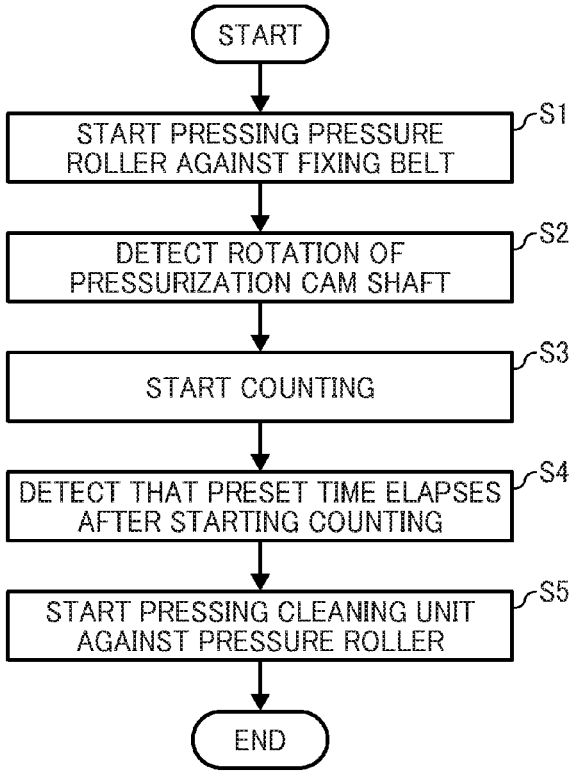
FIG. 6 is a flowchart illustrating control processes for pressing the cleaning unit against the pressure roller.
Figure 7:
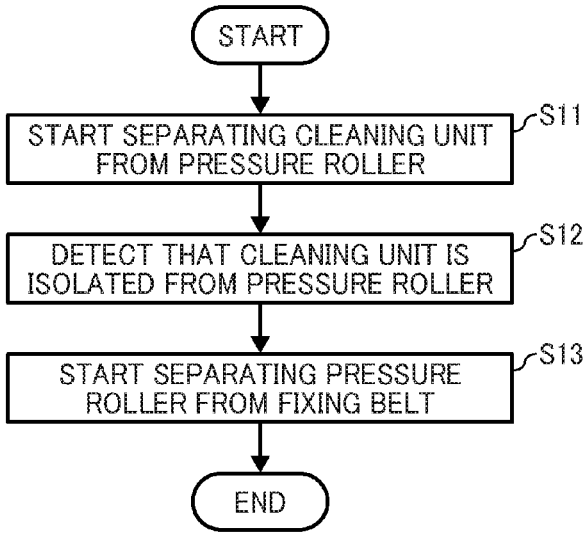
FIG. 7 is a flowchart illustrating control processes for separating the cleaning unit from the pressure roller.

FIG. 5 is a timing chart showing control processes for moving the pressure roller 7 and the cleaning unit 10. FIG. 6 is a flowchart illustrating control processes for pressing the cleaning unit 10 against the pressure roller 7. FIG. 7 is a flowchart illustrating control processes for separating the cleaning unit 10 from the pressure roller 7.

As shown in FIG. 4, a controller 90 (e.g., a processor), that is, a central processing unit (CPU) provided with a random-access memory (RAM) and a read-only memory (ROM), for example, is operatively connected to the pressurization cam sensor 9 and the cam 2*a* of the pressurization cam assembly 2 and the cleaning unit cam sensor 17 and the cam 15*a* of the cleaning unit cam assembly 15.

With reference to FIGS. 5 and 6, a detailed description is now given of the control processes for pressing the cleaning unit 10 against the pressure roller 7.

As shown in FIGS. 5 and 6, after the pressure roller 7 starts pressing against the fixing belt 5 in step S1, the pressurization cam sensor 9 detects rotation of the pressurization cam shaft 6 of the pressurization cam assembly 2 in step S2. Upon receipt of a detection signal, that is, a high signal, from the pressurization cam sensor 9, the controller 90 starts counting in step S3. When the controller 90 detects that a preset time t1 elapses after starting counting, that is, at a time indicated by a dotted line L1, in step S4, the controller 90 controls the cam

15*a* of the cleaning unit cam assembly 15 to start pressing the cleaning unit 10 against the pressure roller 7 in step S5. Thereafter, the pressure roller 7 reaches a pressurization position where the pressure roller 7 presses against the fixing belt 5 and the cleaning unit 10 reaches a pressurization position where the cleaning unit 10 presses against the pressure roller 7.

With reference to FIGS. 5 and 7, a detailed description is now given of the control processes for separating the cleaning unit 10 from the pressure roller 7.

As shown in FIGS. 5 and 7, in step S11, the cam 15*a* of the cleaning unit cam assembly 15 starts separating the cleaning unit 10 from the pressure roller 7. In step S12, the cleaning unit cam sensor 17 detects the cleaning unit 10 that reaches an isolation position where the cleaning unit 10 is isolated from the pressure roller 7 and outputs a low signal to the controller 90 at a time indicated by a dotted line L2. In step S13, the cam 2*a* of the pressurization cam assembly 2 starts separating the pressure roller 7 from the fixing belt 5 to an isolation position where the pressure roller 7 is isolated from the fixing belt 5. Thus, a series of control processes for separating the pressure roller 7 from the fixing belt 5 is completed.

Alternatively, in step S13, the cam 2*a* of the pressurization cam assembly 2 may be configured to release pressure between the pressure roller 7 and the fixing belt 5.

With the control processes described above, before the pressure roller 7 reaches the pressurization position where the pressure roller 7 presses against the fixing belt 5, the cleaning web 11 does not come into contact with the pressure roller 7, facilitating precise movement of the pressure roller 7 to the pressurization position. Before the pressure roller 7 reaches the isolation position where the pressure roller 7 is isolated from the fixing belt 5, the cleaning web 11 is isolated from the pressure roller 7, facilitating precise movement of the pressure roller 7 to the isolation position. Thus, the cleaning unit 10, as it moves between the pressurization position where it presses against the pressure roller 7 and the isolation position where it is isolated from the pressure roller 7, does not obstruct movement of the pressure roller 7 between the pressurization position where the pressure roller 7 presses against the fixing belt 5 and the isolation position where the pressure roller 7 is isolated from the fixing belt 5. In order to press the cleaning web 11 against the pressure roller 7, immediately after the pressurization cam sensor 9 detects the pressure roller 7 that starts pressing against the fixing belt 5, the cleaning unit 10 starts pressing against the pressure roller 7, preventing delay in starting conveyance of the recording medium S through the fixing nip.

The pressure roller 7 is positioned with respect to the cleaning web 11 as shown in FIG. 2 so that the cleaning web 11 moves after the pressure roller 7 starts moving and the cleaning web 11 comes into contact with the pressure roller 7 after the pressure roller 7 comes into contact with the fixing belt 5. For example, in order to facilitate movement of the rotation shaft A7 of the pressure roller 7, the cleaning web 11 comes into contact with a curved face of the pressure roller 7 disposed opposite a nip face of the pressure roller 7 where the pressure roller 7 presses against the fixing belt 5 via the rotation shaft A7 of the pressure roller 7. An amount of movement of the cleaning unit 10 and the pressure roller 7 is determined properly. For example, even if the pressure roller 7 is isolated from the fixing belt 5 with an increased interval therebetween, the cleaning web 11 is isolated from the pressure roller 7. When the cleaning web 11 is isolated from the pressure roller 7, after the cleaning unit cam sensor 17 detects that the cleaning unit 10 reaches the isolation position where the cleaning unit 10 is isolated from the pressure roller 7, the controller 90 controls the pressurization cam assembly 2 to start separating the pressure roller 7 from the fixing belt 5, thus facilitating stable movement of the pressure roller 7 relative to the fixing belt 5.

A driver of the cleaning unit cam assembly 15 is independent from a driver of the pressurization cam assembly 2. Accordingly, even if the pressure roller 7 is at the pressurization position where the pressure roller 7 presses against the fixing belt 5, the driver of the cleaning unit cam assembly 15 selectively moves the cleaning unit 10 between the pressurization position where the cleaning unit 10 presses against the pressure roller 7 and the isolation position where the cleaning unit 10 is isolated from the pressure roller 7. Hence, the controller 90 controls the cleaning unit cam assembly 15 to move the cleaning unit 10 according to the type of a recording medium S used in a print job. For example, when the recording medium S is coated paper from which contaminants are barely transferred and accumulated onto the fixing belt 5 and the pressure roller 7, the controller 90 controls the cleaning unit cam assembly 15 to separate the cleaning web 11 from the pressure roller 7, thus extending life of the cleaning web 11. Conversely, when the recording medium S is plain paper from which contaminants are readily transferred and accumulated onto the fixing belt 5 and the pressure roller 7, the controller 90 controls the cleaning unit cam assembly 15 to bring the cleaning web 11 into contact with the pressure roller 7.

As shown in FIG. 4, the driver 91 operatively connected to the controller 90 and the take-up reel 13 may generate a driving force that changes the reel speed of the take-up reel 13 to reel up the cleaning web 11. Hence, the controller 90 changes the reel speed of the take-up reel 13 according to the type of a recording medium S used in a print job. For example, when the recording medium S is coated paper from which contaminants are barely transferred and accumulated onto the fixing belt 5 and the pressure roller 7, the cleaning web 11 does not receive an increased amount of contaminants from the pressure roller 7 that may be further transferred back from the cleaning web 11 onto the pressure roller 7. Accordingly, the controller 90 controls the driver 91 to decrease the reel speed of the take-up reel 13 to reel up the cleaning web 11, thus extending life of the cleaning web 11. Conversely, when the recording medium S is plain paper from which contaminants are readily transferred and accumulated onto the fixing belt 5 and the pressure roller 7, the controller 90 controls the driver 91 to increase the reel speed of the take-up reel 13 to reel up the cleaning web 11 relative to the reel speed for coated paper.

A description is provided of advantages of the fixing device 1 described above.

As shown in FIGS. 2 and 3, the fixing device 1 includes the fixing belt 5 serving as a fixing rotary body to heat a toner image T on a recording medium S, thus fixing the toner image T on the recording medium S. The pressure roller 7 serves as a pressing rotary body to press against the fixing belt 5 to form a fixing nip therebetween. The pivotable pressure lever 8 rotatably mounts the pressure roller 7. The pressurization cam assembly 2 contacts the pressure lever 8 to pivot the pressure lever 8 to press the pressure roller 7 against the fixing belt 5 and separate the pressure roller 7 from the fixing belt 5 in a direction A8. The cleaning web 11 separably contacts the pressure roller 7 to clean an outer circumferential surface of the pressure roller 7. The pressure adjuster 12 contacts the cleaning web 11 to separably press the cleaning web 11 against the pressure roller 7. The take-up reel 13 reels up the cleaning web 11. The supply reel 14 reels out the cleaning web 11. The pivotable cleaning unit 10 accommodates the cleaning web 11, the pressure adjuster 12, the take-up reel 13, and the supply reel 14. The cleaning unit cam assembly 15 contacts the cleaning unit 10 to pivot the cleaning unit 10 to press against and separate from the pressure roller 7.

Since the cleaning web 11 comes into contact with the pressure roller 7, not the fixing belt 5, the cleaning web 11 does not damage the outer circumferential surface of the fixing belt 5 that comes into contact with the toner image T on the recording medium S. The cleaning web 11 collects contaminants on the pressure roller 7 that are transferred from the fixing belt 5. Thus, the cleaning web 11 collects a part of contaminants transferred from the fixing belt 5, reducing consumption of the cleaning web 11 and therefore extending its life without degrading quality of the toner image T formed on the recording medium S.

According to the example embodiments described above, the pressurization cam assembly 2 presses the pressure roller 7 against the fixing belt 5 and separates the pressure roller 7 from the fixing belt 5. Alternatively, the pressurization cam assembly 2 may press the pressure roller 7 against the fixing belt 5 and release or reduce pressure between the pressure roller 7 and the fixing belt 5. Yet alternatively, the pressurization cam assembly 2 may bring the pressure roller 7 into contact with the fixing belt 5 and separate the pressure roller 7 from the fixing belt 5.

According to the example embodiments described above, the fixing belt 5 serves as a fixing rotary body. Alternatively, an endless film, a fixing roller, or the like may be used as a fixing rotary body. If the fixing roller is used as a fixing rotary body, the pressure roller 7 is pressed against the fixing roller to form a fixing nip therebetween through which a recording medium bearing a toner image is conveyed.

Further, the pressure roller 7 serves as a pressing rotary body. Alternatively, a pressing belt or the like may be used as a pressing rotary body.

The present invention has been described above with reference to specific example embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative example embodiments may be combined with each other and/or substituted for each other within the scope of the present invention.

What is claimed is:

1. A fixing device comprising:

a fixing rotary body;

a pressing rotary body to press against the fixing rotary body to form a fixing nip therebetween through which a recording medium is conveyed;

a pivotable pressure lever rotatably mounting the pressing rotary body;

a pressurization cam assembly contacting the pressure lever to pivot the pressure lever to press the pressing rotary body against the fixing rotary body and release pressure between the pressing rotary body and the fixing rotary body;

a pivotable cleaning unit separably pressed against the pressing rotary body and including:

a cleaning web separably contacting the pressing rotary body to clean the pressing rotary body;

a pressure adjuster contacting the cleaning web to separably press the cleaning web against the pressing rotary body;

a take-up reel to reel up the cleaning web; and a supply reel to reel out the cleaning web; and a cleaning unit cam assembly contacting the cleaning unit to pivot the cleaning unit to press against and separate from the pressing rotary body, wherein a center of gravity of the cleaning unit is situated in a region defined by a vertical perpendicular passing through a pivot shaft of the cleaning unit and a vertical perpendicular passing through a rotation shaft of the pressing rotary body.

2. The fixing device according to claim 1, wherein the pressure adjuster includes a roller made of sponge.

3. The fixing device according to claim 1, wherein the fixing rotary body includes a fixing belt and the pressing rotary body includes a pressure roller.

4. A fixing device comprising:

a fixing rotary body;

a pressing rotary body to press against the fixing rotary body to form a fixing nip therebetween through which a recording medium is conveyed;

a pivotable pressure lever rotatably mounting the pressing rotary body;

a pressurization cam assembly contacting the pressure lever to pivot the pressure lever to press the pressing rotary body against the fixing rotary body and release pressure between the pressing rotary body and the fixing rotary body;

a pivotable cleaning unit separably pressed against the pressing rotary body to clean the pressing rotary body;

a cleaning unit cam assembly contacting the cleaning unit to pivot the cleaning unit to press against and separate from the pressing rotary body; and a controller operatively connected to the pressurization cam assembly and the cleaning unit cam assembly, the controller to selectively control the pressurization cam assembly to press the pressing rotary body against the fixing rotary body and the cleaning unit cam assembly to press the cleaning unit against the pressing rotary body, wherein a center of gravity of the cleaning unit is situated in a region defined by a vertical perpendicular passing through a pivot shaft of the cleaning unit and a vertical perpendicular passing through a rotation shaft of the pressing rotary body.

5. The fixing device according to claim 4, wherein the controller controls the cleaning unit cam assembly to start pressing the cleaning unit against the pressing rotary body when a preset time elapses after controlling the pressurization cam assembly to start pressing the pressing rotary body against the fixing rotary body.

6. The fixing device according to claim 5, wherein the controller controls the pressurization cam assembly to start releasing pressure between the pressing rotary body and the fixing rotary body after controlling the cleaning unit cam assembly to start separating the cleaning unit from the pressing rotary body.

7. The fixing device according to claim 4, wherein the controller controls the cleaning unit cam assembly according to a type of the recording medium while the pressurization cam assembly presses the pressing rotary body against the fixing rotary body.

8. The fixing device according to claim 7, wherein the controller controls the cleaning unit cam assembly to separate the cleaning unit from the pressing rotary body when the recording medium is coated paper.

9. The fixing device according to claim 7, wherein the controller controls the cleaning unit cam assembly to press the cleaning unit against the pressing rotary body when the recording medium is plain paper.

10. The fixing device according to claim 4, wherein the controller controls the cleaning unit cam assembly to press the cleaning unit against the pressing rotary body while the pressurization cam assembly presses the pressing rotary body against the fixing rotary body.

11. The fixing device according to claim 10, wherein the cleaning unit includes:

a cleaning web separably contacting the pressing rotary body to clean the pressing rotary body;

a pressure adjuster contacting the cleaning web to separably press the cleaning web against the pressing rotary body;

a take-up reel to reel up the cleaning web;

a supply reel to reel out the cleaning web; and a driver connected to the take-up reel to drive the take-up reel, and wherein the controller controls the driver to change a reel speed of the take-up reel to reel up the cleaning web according to a type of the recording medium.

12. An image forming apparatus comprising the fixing device according to claim 1.

13. A fixing method comprising:

starting pressing a pressing rotary body against a fixing rotary body;

detecting that the pressing rotary body starts pressing against the fixing rotary body;

starting counting;

detecting that a preset time elapses after starting counting; and starting pressing a cleaning unit against the pressing rotary body.

14. The fixing method according to claim 13, further comprising:

starting separating the cleaning unit from the pressing rotary body;

detecting that the cleaning unit is isolated from the pressing rotary body; and starting releasing pressure between the pressing rotary body and the fixing rotary body.

* * * * *